US005910389A

United States Patent [19]

Matsumura et al.

[11] Patent Number: 5,910,389

[45] Date of Patent: Jun. 8, 1999

[54] METHOD FOR PRODUCING TONER FOR DEVELOPING IMAGES OF ELECTROSTATIC CHARGE, TONER FOR DEVELOPING IMAGES OF ELECTROSTATIC CHARGE, DEVELOPER FOR IMAGES OF ELECTROSTATIC CHARGE AND METHOD FOR FORMING IMAGES

[75] Inventors: Yasuo Matsumura; Manabu Serizawa; Masaaki Suwabe; Shuji Sato; Yasuo Kadokura; Hisao Morijiri; Takeshi Shoji; Takahiro Mizoguchi, all of Minami-Ashigara, Japan

[73] Assignee: Fuji Xerox Co., Ltd., Tokyo, Japan

[21] Appl. No.: 08/962,703

[22] Filed: Nov. 3, 1997

[30] Foreign Application Priority Data

Nov. 5, 1996 [JP] Japan ..... 8-292538

[51] Int. Cl.[6] ..... G03G 9/16

[52] U.S. Cl. ..... 430/111; 430/137

[58] Field of Search ..... 430/137, 109, 430/110, 111

[56] References Cited

U.S. PATENT DOCUMENTS

| | | | |
|---|---|---|---|
| 5,278,020 | 1/1994 | Grushkin et al. | 430/137 |
| 5,370,963 | 12/1994 | Patel et al. | 430/137 |
| 5,716,746 | 2/1998 | Mikuriya et al. | 430/137 |

FOREIGN PATENT DOCUMENTS

| | | |
|---|---|---|
| 49-91231 | 8/1974 | Japan . |
| A 56-11461 | 2/1981 | Japan . |
| A 56-40868 | 4/1981 | Japan . |
| A 62-39879 | 2/1987 | Japan . |
| A 63-282752 | 11/1988 | Japan . |
| A 6-250439 | 9/1994 | Japan . |
| A 6-282099 | 10/1994 | Japan . |

OTHER PUBLICATIONS

"Chemistry of Polymer Latices," published by Kohbunshi Kankoh Kai.

*Primary Examiner*—John Goodrow
*Attorney, Agent, or Firm*—Oliff & Berridge, PLC

[57] ABSTRACT

According to the present invention, the method for producing toner for developing an image of electrostatic charge comprises the steps of producing a dispersion liquid of flocculated particles by forming the flocculated particles in a dispersion liquid comprising at least dispersed resin particles, forming combined particles by dispersing a liquid dispersion comprising dispersed fine resin particles into the dispersion liquid of flocculated particles so that the fine resin particles adhere to the flocculated particles and forming toner particles by fusing the combined particles by heating, wherein the molecular weight distribution curve of the resin in the toner particles by a gel permeation chromatography has at least two peaks or shoulders. According to the present invention, it is possible to produce toner for developing an image of electrostatic charge which is particularly superior in chargeability and the stability of the chargeability.

18 Claims, No Drawings

METHOD FOR PRODUCING TONER FOR DEVELOPING IMAGES OF ELECTROSTATIC CHARGE, TONER FOR DEVELOPING IMAGES OF ELECTROSTATIC CHARGE, DEVELOPER FOR IMAGES OF ELECTROSTATIC CHARGE AND METHOD FOR FORMING IMAGES

BACKGROUND OF THE INVENTION

1. Field of the Invention

The present invention relates to a method for efficiently producing toner for developing an image of electrostatic charge which is superior in various properties such as chargeability and is suitable for use in the image formation in such application as electrophotography, toner for developing an image of electrostatic charge which is produced by the method, and a developer for an image of electrostatic charge and a method for forming an image by utilizing the toner for developing an image of electrostatic charge.

2. Description of the Related Art

A method in which image information is made visible via an image of electrostatic charge as in electrophotography and the like is widely used currently in various fields. Electrophotography consists of forming an image of electrostatic charge on a photoreceptor through charging and exposure steps, developing the image of electrostatic charge with a developer containing toner particles, and making the developed image visible via transfer and fixation steps.

By the way, there are two types of known developer, a two-component developer which comprises toner particles and carrier particles, and a one-component developer which comprises either magnetic toner particles or non-magnetic toner particles. These toner particles are usually prepared by a blending/pulverizing process. The blending/pulverizing process comprises melting and blending a thermoplastic resin with a pigment, a charge inhibitor and a release agent such as a wax, pulverizing the resultant product after cooling, and classifying the pulverized product by size to obtain the desired toner. If necessary, for the purpose of improving such properties as fluidity and cleanability of the thus prepared toner particles, inorganic and/or organic particles are added to the surface to the toner particles.

Usually, the shapes of the toner particles prepared in the above-mentioned blending/pulverizing process are irregular and the surface compositions of the toner particles are not uniform. The shapes and surface compositions of the toner particles vary slightly depending on the pulverizability of the materials and the pulverizing conditions. However, it is difficult to control the shapes and surface compositions of the toner particles within a desired range. Furthermore, if the materials of the toner particles are particularly easy to pulverize and the toner particles are prepared by the blending/pulverizing process, the toner particles are often pulverized further in a developing device by mechanical forces such as a shearing force causing the shapes of the toner particles to change. Accordingly, the problems to be encountered in the case of the two-component developer are accelerated degradation of the chargeability of the developer due to tenacious adhesion of the fine toner particles to the carrier surface, while the problems to be encountered in the case of the one-component developer are the broadening of the particle size distribution accompanied by the dissipation of the fine toner particles and the degradation of image due to diminished developing performance of the toner caused by the change of the shapes of the toner.

Further, if the shapes of the toner particles are irregular, a sufficient level of fluidity cannot be obtained even if a fluidity improving agent is added. Consequently, the problems are that the fluidity decreases with time because a mechanical force such as a shearing force causes the particles of the fluidity improving agent to move to cavities of the toner particles. When the improving agent becomes embedded in such cavities, performances such as developability, transferability and cleanability are reduced. In addition, if such toner particles are recovered by a cleaning treatment are used after being recycled to the developing device, the quality of the obtained image will be inferior. If the amount of the fluidity improving agent is increased in order to prevent the above-mentioned problems, new problems such as generation of black spots on the photoreceptor and the dissipation of the toner particles arise.

Meanwhile, if the toner particles contain a surface lubricant such as a wax, the release agent may be exposed to the surface of the toner particles depending on the combination of the release agent and a thermoplastic resin. In particular, if the toner particles utilize a combination of a resin whose elasticity is created by a polymeric component and which is somewhat difficult to pulverize and a brittle wax such as polyethylene, a significant proportion of the polyethylene is exposed to the surface of the toner particles. Although these toner particles are advantageous in terms of release in the fixing process and cleaning the photoreceptor of the untransferred toner, a mechanical force such as a shearing force inside the developing device causes the polyethylene to separate from the toner particles and to migrate to such members as developing rolls, a photoreceptor and carriers. Consequently, because of the contamination of these members, the reliability of the developer drops.

In order to overcome the above-mentioned problems, Japanese Patent Application Laid-Open (JP-A) Nos. 63-282,752 and 6-250,439 disclose an emulsion polymerization/flocculation process as a method for producing toner particles whose shapes and surface compositions are controlled. The emulsion polymerization/flocculation process comprises the steps of preparing a resin dispersion liquid by an emulsion polymerization on the one hand, preparing a colorant dispersion comprising a solvent and a colorant dispersed therein on the other hand, blending the two dispersions to prepare flocculated particles having a particle size corresponding to the toner particle diameter, and then heating the blend to fuse the particles and to obtain toner particles. According to the emulsion polymerization/flocculation process, it is possible to control the shapes of the toner particles at will from an irregular shape to a sphere by selecting the heating temperatures. A method of manufacturing toner by flocculating fine resin particles is outlined in Japanese Patent Application Laid-Open (JP-A) No. 6-282099. In this application, resins with high softening points and resins with low softening points are used.

In the emulsion polymerization/flocculation process, however, the problem is that it is difficult to control intentionally the structure and composition of the surface of the toner particles, because the composition in the region ranging from toner particle interior to the particle surface is made uniform by the fusion of the flocculated particles in a uniformly blended state. If the flocculated particles contain a release agent, the surface of the toner particles after fusion bears the release agent, which may lead to a filming phenomenon and the embedding of a fluidity improving agent employed as an external additive into the interior of the toner particles.

In an electrophotographic process, in order to maintain and exhibit the performance of toner in a stable manner, it is necessary to inhibit the exposure of the lubricant to the surface of toner particles, to increase the surface hardness of the toner particles and to increase the smoothness of the surface of the toner particles. Despite the possible problems arising from release agent exposure to the surface of the toner particles, it is preferable that the lubricant be present in the vicinity of the surface of the toner particles if the toner performance at the time of fixation is taken into consideration.

Recently, because of a mounting demand for high-quality images, the diameter of the toner particles is remarkably reduced in order to realize a high-precision image particularly in the formation of a color image. However, if the conventional particle size distribution of toner is maintained unchanged, it is difficult to achieve high quality images and high reliability simultaneously by the mere reduction in particle size of toner, because serious problems such as contamination of the carriers and photoreceptor as well as dissipation of the toner particles are caused by toner particles existing in a region of finer particles of the particle size distribution. In order to achieve high quality images and high reliability simultaneously, it is necessary to sharpen the particle size distribution of the toner particles and reduce the particle size.

Accordingly, the present invention intends to overcome the problems of prior art and to achieve the following objectives.

In the present invention, the structure and composition in the region ranging from the surface to the interior of the toner particle are controlled to achieve the following objectives:

1. To provide toner for developing an image of electrostatic charge which is superior in various properties such as chargeability, developability, transferability, fixability and cleanability and particularly in chargeability as well as a developer utilizing the toner for developing an image of electrostatic charge;
2. To provide toner for developing an image of electrostatic charge which is capable of maintaining and exhibiting the above-mentioned properties and particularly the chargeability without being influenced by environmental conditions and which has a high reliability as well as a developer utilizing the toner for developing an image of electrostatic charge;
3. To provide toner for developing an image of electrostatic charge suitable to a two-component developer for an image of electrostatic charge which consumes a small amount of the toner and yet has a long life;
4. To provide an easy and simple method for producing toner for developing an image of electrostatic charge which is superior in the above-mentioned properties;
5. To provide an easy and simple method for forming a full-color image having a high-quality and a high reliability;
6. To provide a method for forming an image which ensures a high quality of image in a system having no cleaning mechanism, namely, a cleaner-less system; and
7. To provide a method for forming an image which is highly adapted to a toner-recycle system reusing the toner recovered from a cleaner and which ensures a high quality of image.

SUMMARY OF THE INVENTION

The objectives stated above are achieved by the following means.

The first means is a method for producing toner for developing an image of electrostatic charge, comprising the steps of producing a dispersion liquid of flocculated particles by forming the flocculated particles in a dispersion liquid comprising at least dispersed resin particles, forming combined particles by dispersing a liquid dispersion comprising dispersed fine resin particles into the dispersion liquid of the flocculated particles so that the fine resin particles adhere to the flocculated particles and forming toner particles by fusing the combined particles by heating, wherein the molecular weight distribution curve of the resin in the toner particles by a gel permeation chromatography has at least two peaks or shoulders.

The second means is a toner for developing an image of electrostatic charge, obtained by a procedure comprising the steps of producing a dispersion liquid of flocculated particles by forming the flocculated particles in a dispersion liquid comprising at least dispersed resin particles, forming combined particles by dispersing a liquid dispersion comprising dispersed fine resin particles into the dispersion liquid of the flocculated particles so that the fine resin particles adhere to the flocculated particles and forming toner particles by fusing the combined particles by heating, wherein the molecular weight distribution curve of the resin in the toner particles by a gel permeation chromatography has at least two peaks or shoulders.

The third means is a developer for an image of electrostatic charge which comprises carriers and toner wherein the toner is the above-described toner for developing an image of electrostatic charge.

The fourth means is a method for forming an image which comprises the steps of forming an electrostatic latent image on an electrostatic latent image carrier, developing the electrostatic latent image by means of a developer layer on a developer carrier to form a toner image, and transferring the toner image to an image receiving medium, wherein the developer layer contains the above-described toner for developing an image of electrostatic charge.

DESCRIPTION OF THE PREFERRED EMBODIMENTS method for producing toner for developing an image of electrostatic charge The method for producing toner for developing an image of electrostatic charge according to the present invention comprises the steps of producing a dispersion liquid of flocculated particles by forming the flocculated particles in a dispersion liquid comprising at least dispersed resin particles (hereinafter referred to as "a first step" upon occasion), forming combined particles by dispersing a liquid dispersion comprising dispersed fine resin particles into the dispersion liquid of the flocculated particles so that the fine resin particles adhere to the flocculated particles (hereinafter referred to as "a second step" upon occasion) and forming toner particles by fusing the combined particles by heating (hereinafter referred to as "a third step" upon occasion).

In the first step, the resin particles contained in the dispersion liquid flocculate to form the flocculated particles. In the second step, the flocculated particles serve as mother particles such that the fine resin particles, contained in the dispersion liquid of fine resin particles which is added to the dispersion liquid of the flocculated particles, adhere to the surface of the flocculated particles and consequently the combined particles are formed. The flocculated particles and combined particles are prepared by, for example, a heterogeneous flocculation method. More specifically, when forming the particles, the amounts of an ionic surfactant in the adding dispersion liquid and in the receiving dispersion liquid are set in an unequal relationship in advance and the two dispersion liquids are combined such that the difference in the amounts of the surfactant is compensated. In the third step, the resins in the combined particles are fused to be united and consequently the toner particles for developing an image of electrostatic charge are formed.

the first step

The first step is a step where a dispersion liquid of flocculated particles are prepared by forming the flocculated particles in a dispersion liquid (hereinafter the first step is referred to as "a flocculation step" upon occasion).

The dispersion liquid comprises at least dispersed resin particles.

The resin is a thermoplastic resin, examples of which include homopolymers or copolymers of styrenes (styrene-based resins) made from, for example, styrene, parachlorostyrene and α-methylstyrene; homopolymers or copolymers of vinyl group bearing esters (vinyl-based resins) made from, for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate; homopolymers or copolymers of vinyl nitriles (vinyl-based resins) made from, for example, acrylonitrile and methacrylonitrile; homopolymers or copolymers of vinyl ethers (vinyl-based resins) made from, for example, vinyl methyl ether and vinyl isobutyl ether; homopolymers or copolymers of vinyl ketones (vinyl-based resins) made from, for example, vinyl methyl ketone, vinyl ethyl ketone and vinyl isopropenyl ketone; homopolymers or copolymers of olefins (olefin-based resins) made from, for example, ethylene, propylene, butadiene and isoprene; non-vinyl condensation resins such as epoxy resins, polyester resins, polyurethane resins, polyamide resins, cellulose resins and polyether resins; and graft polymers made from any of these non-vinyl condensation resins and a vinyl monomer. These resins may be used singly or in a combination of two or more of them.

Among the foregoing resins, vinyl-based resins are particularly preferable. The vinyl-based resins are advantageous in that a dispersion liquid of resin particles can be easily prepared by an emulsion polymerization or a seed polymerization utilizing an ionic surfactant or the like.

Examples of the vinyl monomers are those which serve as a starting material for vinyl polymer acids or vinyl polymer bases and which include acrylic acid, methacylic acid, maleic acid, cinnamic acid, fumaric acid, vinylsulfonic acid, ethyleneimine, vinylpyridine, and vinylamine. In the present invention, it is preferable that the resin particles comprise any of these vinyl monomers as a monomer component. In the present invention, among the foregoing vinyl monomers, monomers for vinyl polymer acids are preferable from the aspect of ease in the vinyl resin formation. Particularly preferable vinyl monomers are vinyl monomers capable of dissociation due to attached carboxyl groups as a dissociating group, and examples of these monomers include acrylic acid, methacylic acid, maleic acid, cinnamic acid and fumaric acid. These monomers are preferable because of ease in controlling degrees of polymerization and glass transition points.

For the determination of the concentration of the dissociating group of the above-mentioned vinyl monomers capable of dissociation, an employable method is, for example, a method which is described in "Chemistry of Polymer Latices" (published by Kohbunshi Kankoh Kai). The particles are dissolved from the surface and the concentration is measured. That is, if the dissociating group is a carboxyl group, the pH of the environment surrounding the particles is gradually raised so that a resin having the carboxyl group is dissolved. Then, the dissolved resin is separated by means of centrifugal separation or by gel permeation, and the concentration of the dissociating group is measured. According to this method, it is also possible to measure the molecular weight and the glass transition point of the resin in the region ranging from the surface to the interior of the particle.

As for the average particle diameter of the resin particles, it is preferable that the maximum be 1 μm (1 μm or less), and the diameter be within the range of from 0.01 to 1 μm. If the average particle diameter is greater than 1 μm, the particle size distribution of the resultant toner for developing an image of electrostatic charge is broadened or isolated particles are generated, and therefore performance and reliability tend to drop. On the other hand, if the average diameter is within this range, the resin particles overcome the above-mentioned drawbacks and provide the advantage that inconsistencies in performance and reliability diminishes because the resin particles are uniformly divided among toner particles and well dispersed in the toner. The average diameter can be measured with, for example, a Coulter counter.

In the present invention, the above-mentioned dispersion liquid needs to contain a colorant dispersed therein, if the dispersion liquid of fine resin particles to be used in the second step that will be explained later contains no colorant. In this case, a colorant may be dispersed in the dispersion liquid comprising the dispersed resin particles, or otherwise a dispersion liquid comprising dispersed colorant may be blended into the dispersion liquid comprising the dispersed resin particles.

Examples of the colorants include pigments such as carbon black, chromium yellow, Hansa yellow, benzidine yellow, threne yellow, quinoline yellow, permanent orange GTR, pyrazolone orange, Balkan orange, watching red, permanent red, brilliant carmine 3B, brilliant carmine 6B, DuPont oil red, pyrazolone red, Lithol red, rhodamine B lake, lake red C, rose bengal, aniline blue, ultramarine blue, chalcoyl blue, methylene blue chloride, phthalocyanine blue, phthalocyanine green, and Malachite green oxalate; and dyes such as acridine dyes, xanthene dyes, azo dyes, benzoquinone dyes, azine dyes, anthraquinone dyes, dioxazine dyes, thiazine dyes, azomethine dyes, indigo dyes, thioindigo dyes, phthalocyanine dyes, aniline black dyes, polymethine dyes, triphenylmethane dyes, diphenylmethane dyes, thiazine dyes, thiazole dyes, and xanthene dyes. These colorants may be used singly or in a combination of two or more of them.

As for the average particle diameter of the colorants, it is preferable that the maximum be 1 μm (1 μm or less), and the diameter be within the range of from 0.01 to 1 μm. If the average particle diameter is greater than 1 μm, the particle size distribution of the resultant toner for developing an image of electrostatic charge is broadened or isolated particles are generated, and therefore performance and reliability tend to suffer. On the other hand, if the average diameter is within this range, the resin particles overcome the above-mentioned drawbacks and provide the advantage that inconsistencies in performance and reliability diminishes because the colorant particles are uniformly divided among toner particles and well dispersed in the toner. The average diameter can be measured with, for example, a Coulter counter.

If the colorant and the resin particles are used together in the dispersion liquid mentioned above, the combination is not particularly limited and a combination is selected at will depending on the purpose.

In the present invention, depending on the purpose, the dispersion liquid may contain dispersed therein other ingredients such as a release agent, an internal additive, a charge controller, particles of an inorganic substance, a lubricant, and an abrasive. In this case, particles of the other substance may be dispersed in the dispersion liquid comprising the dispersed resin particles, or otherwise a dispersion liquid comprising dispersed particles of the other substance may be blended into the dispersion liquid comprising the dispersed resin particles.

Examples of the release agent include polyolefins having a low molecular weight such as polyethylene, polypropylene and polybutene, silicones which soften on heating, fatty acid amides such as oleic acid amide, erucic acid amide, ricinoleic acid amide and stearic acid amide, vegetable waxes such as carnauba wax, rice wax, candelilla wax, wood wax and hohoba oil, animal waxes such as beeswax, mineral/petroleum waxes such as montan wax, ozokerite, ceresin, paraffin wax, microcrystalline wax and Fischer-Tropsch wax, and modified products of these substances.

These waxes can be easily converted into particles having a particle diameter of 1 μm or less by a procedure comprising dispersing the wax in water together with an ionic surfactant and a polymer electrolyte such as a polymer acid and a polymer base, and applying a strong shearing force to the resultant dispersion by means of a homogenizer or a pressure-ejection type dispersing machine at a temperature above the melting point of the wax.

Examples of the internal additives include magnetic substances including metals and alloys such as ferrite, magnetite, reduced iron, cobalt, nickel and manganese as well as compounds containing these metals.

Examples of the charge controllers include quaternary ammonium compounds, nigrosine compounds, dyes composed of a complex of aluminum, iron, chromium and the like, and triphenylmethane pigments. In the present invention, the charge controller preferably has a low solubility in water from the viewpoint of the control of the ionic strength that influences the stability at the time of flocculation and fusion and from the viewpoint of reduction of the contaminated waste water.

Examples of the inorganic particles include all of the inorganic particles, such as silica, alumina, titania, calcium carbonate, magnesium carbonate, calcium phosphate and cerium oxide, which are usually used as external additives to the surface of toner.

Examples of the lubricants include fatty acid amide, such as ethylenebisstearic acid amide and oleic acid amide, and metal salts of fatty acids such as zinc stearate and calcium stearate.

Examples of the abrasives include silica, alumina and cerium oxide mentioned above.

As for the average particle diameter of the above-mentioned ingredients, it is preferable that the maximum be 1 μm (1 μm or less), and the diameter be within the range of from 0.01 to 1 μm. If the average particle diameter is greater than 1 μm, the particle size distribution of the finally resultant toner for developing an image of electrostatic charge is broadened or isolated particles are generated, and therefore performance and reliability tend to suffer. On the other hand, if the average diameter is within this range, the resin particles overcome the above-mentioned drawbacks and provide the advantage that inconsistencies in performance and reliability diminishes because these ingredients are uniformly divided among toner particles and well dispersed in the toner. The average diameter can be measured with, for example, a Coulter counter.

An example of the dispersing medium of the aforementioned dispersion liquids is an aqueous medium. Examples of the aqueous medium include water, such as distilled water and ion-exchanged water, and an alcohol. These media may be used singly or in a combination of two or more of them.

In the present invention, it is preferable that the above-mentioned aqueous medium contain a surfactant.

Examples of the surfactants include anionic surfactants, such as sulfate ester salts, sulfonate salts, phosphate ester salts and soaps, cationic surfactants, such as amine salts and quaternary ammonium salts, and nonionic surfactants such as polyethylene glycol types, alkylphenol/ethylene oxide adducts and polyvalent alcohols. Among these surfactants, anionic surfactants and cationic surfactants are preferable. The nonionic surfactant is used preferably in a combination with an anionic surfactant or cationic surfactant. These surfactants may be used singly or in a combination of two or more of them.

Concrete examples of the anionic surfactants include sodium dodecylbenzene sulfonate, sodium dodecyl sulfate, sodium alkylnaphthalene sulfonate and sodium dialkylsulphosuccinate. Concrete examples of the cationic surfactants include alkylbenzenedimethylammonium chloride, alkyltrimethylammonium chloride, and distearylammonium chloride.

Among these compounds, ionic surfactants, such as anionic surfactants and cationic surfactants, are preferable.

The content of the resin particles in the dispersion liquid is 40% by weight or less, preferably 2 to 20% by weight, in the dispersion liquid of the flocculated particles at the time when the flocculated particles are formed.

When the aforementioned colorant or magnetic substance is dispersed in the above-mentioned dispersion liquid, the content of the colorant or magnetic substance in the dispersion liquid is 50% by weight or less, preferably 2 to 40% by weight, in the dispersion liquid of the flocculated particles at the time when the flocculated particles are formed.

Further, when the aforementioned other ingredient is dispersed in the above-mentioned dispersion liquid, the content of the other ingredient in the dispersion liquid is one which does not impede the objectives of the present invention and which is generally a very small amount, namely, 0.01 to about 5% by weight, and preferably 0.5 to 2% by weight, in the dispersion liquid of the flocculated particles at the time when the flocculated particles are formed. If the content is outside this range, the effect of the other ingredient is insufficient or the overall properties become worse due to the broadening of the particle size distribution.

The aforementioned dispersion liquid comprising at least resin particles dispersed therein is prepared by, for example, the following procedure.

In the case where the resins in the resin particles are homopolymers or copolymers of vinyl monomers (vinyl-based resins) made from the vinyl group bearing esters, vinyl nitrites, vinyl ethers or vinyl ketones, a dispersion liquid, which comprises the resin particles made up of homopolymers or copolymers of vinyl monomers (vinyl-based resins) dispersed in an ionic surfactant, is prepared by carrying out an emulsion polymerization or a seed polymerization of the vinyl monomers in the ionic surfactant.

In the case where the resin in the resin particles are made from other resins than homopolymers and copolymers of vinyl monomers, a dispersion liquid, which comprises the resin particles made up of other resins than vinyl resins dispersed in an ionic surfactant, is prepared by a procedure comprising dissolving the resin in an oily solvent having a relatively low solubility in water, if the resin is soluble in the solvent, dispersing the resultant solution in water together with an ionic surfactant or a polymer electrolyte by means of a dispersing machine such as a homogenizer, and then evaporating the oily solvent by means of heating or reduced pressure.

The dispersing means is not particularly limited, and the dispersing machines themselves to be used are known. Examples of these machines include a homogenizer with a rotating shearing mechanism, a ball mill with media, a sand mill and a Dino mill.

The flocculated particles are prepared by, for example, the following procedure.

A first dispersion liquid, which comprises at least the resin particles dispersed in an aqueous medium containing an ionic surfactant, is blended with (1) an ionic surfactant having a polarity opposite to that of the foregoing ionic surfactant, or (2) an aqueous medium in which the ionic surfactant of (1) is blended, or (3) a second dispersion liquid containing the aqueous medium of (2). If the resultant mixture is stirred, the ionic surfactant causes the resin particles and others to flocculate in the dispersion liquid so that flocculated particles are produced from the resin particles and others. As a result, a dispersion liquid of flocculated particles is prepared.

The above-described blending operation is carried out preferably at a temperature below the glass transition point of the resins contained in the mixture. The blending operation at such a temperature ensures a stable flocculating operation.

The second dispersion liquid mentioned above comprises dispersed therein the resin particles, the colorants and/or the other particles. The stirring of the mixture can be performed by means of known machines such as a homogenizer and a mixer.

In the case of (1) or (2), the flocculated particles are formed by the flocculation of the resins dispersed in the first dispersion liquid.

The content of the resin particles in the first dispersion liquid is usually 5 to 60% by weight, and preferably 10 to 40% by weight. The content of the flocculated particles in the dispersion liquid of the flocculated particles, when the flocculated particles are formed, is usually 40% by weight or less.

In the case of (3), if the particles dispersed in the second dispersion liquid are the resin particles, the flocculated particles are composed of the resin particles of the second dispersion liquid and the resin particles dispersed in the first dispersion liquid. Meanwhile, if the particles dispersed in the second dispersion liquid are the colorants and/or the other particles, the flocculated particles are heterogeneously flocculated particles composed of these colorants and/or the other particles and the resins dispersed in the first dispersion liquid. Furthermore, if the particles dispersed in the second dispersion liquid are the resin particles, the colorants and/or the other particles, the flocculated particles are composed of the resin particles, the colorants and/or the other particles and the resins dispersed in the first dispersion liquid.

The content of the resin particles in the first dispersion liquid is usually 5 to 60% by weight, and preferably 10 to 40% by weight. The content of the resin particles, the colorants and/or the other particles in the second dispersion liquid is usually 5 to 60% by weight, and preferably 10 to 40% by weight. If the content is outside this range, the overall properties may become worse due to the broadening of the particle size distribution. The content of the flocculated particles in the dispersion liquid of the flocculated particles, when the flocculated particles are formed, is usually 40% by weight or less.

When the flocculated particles or the combined particles are formed, the polarity of the ionic surfactant in the adding dispersion liquid and the polarity of the ionic surfactant in the receiving liquid are preferably set to an opposite polarity to each other so that the balance in polarity varies.

Although the average particle diameter of the flocculated particles to be formed is not particularly limited, the average particle diameter of the flocculated particles is usually controlled to approximately the same average particle diameter as that of the target toner particles for developing an image of electrostatic charge. The controlling operation for this purpose can be easily performed by setting/altering the conditions of, for example, temperatures and the blending operations.

According to the first step described above, the flocculated particles are formed which have approximately the same average particle diameter as that of the target toner particles for developing an image of electrostatic charge. And, a dispersion liquid comprising the flocculated particles dispersed therein is formed. In the present invention, the above-mentioned flocculated particles are referred to as "mother particles" upon occasion.

a second step

A second step consists in the formation of combined particles by dispersing a liquid dispersion comprising dispersed fine resin particles into the dispersion liquid of the flocculated particles so that the fine resin particles adhere to the flocculated particles (hereinafter the second step is referred to as "a combining step" upon occasion).

The fine resin particles comprise at least one of the aforementioned resins. The fine resin particles adhere to the surface of the flocculated particles to thereby form combined particles and the resultant combined particles are fused by heating in the third step which will be described later. By this procedure, if the flocculated particles contain such ingredients as a colorant and a release agent, the surface of these ingredients is coated with the resin of the fine resin particles (formation of a shell), which effectively prevents these ingredients such as a release agent and the like from being exposed from the toner particles.

The preferred resins as a resin for the fine resin particles are the same as the preferred resins for the resin particles enumerated previously. In the present invention, it is important to select the resin in the fine resin particles by fulfilling the following conditions.

In the present invention, the molecular weight distribution Mw/Mn (weight average molecular weight/number average molecular weight) of the mixture of resins in various regions of the toner particle to be obtained in the third step that will be described later, that is, the mixture of the resin in the resin particle as a core and of the resin in the fine resin particle as a coating layer, needs to present a curve by gel permeation chromatography having at least two (two or more) peaks or shoulders. If the obtained toner for developing an image of electrostatic charge fulfills this condition, it is possible to effectively lower the minimum fixing temperature and to prevent the offset.

On the other hand, if this molecular weight distribution curve by gel permeation chromatography presents no clear peak, the offset to a heat roll may not be effectively prevented. Furthermore, if this molecular weight distribution curve by gel permeation chromatography presents only one peak, the possible problem is that the minimum fixing temperature rises because the melt flow by means of the heat roll becomes inferior, even if the offset is effectively prevented.

As regards fixing properties, offset properties, transfer properties, and cleaning properties, the resin in the toner particles has at least one peak or shoulder in the range of 5,000 to 200,000 and at least one peak or shoulder in the range of 50,000 to 1,000,000 are preferably used.

The above-mentioned molecular weight distribution curve by gel permeation chromatography can be obtained by use of a commercially available apparatus and according to a known method of gel permeation chromatography. This gel permeation chromatography is generally performed by use of a column utilizing polystyrene as a standard substance and tetrahydrofuran.

In order that the molecular weight distribution curve by gel permeation chromatography has at least two (two or more) peaks or shoulders, the molecular weight distribution Mw/Mn of the resin corresponding to the lower molecular weight side of the at least two (two or more) peaks or shoulders should be somewhat reduced to a value of preferably 6.0 or less, and more preferably 5.0 or less. Meanwhile, the resin can serve basically as an elasticity imparting resin for toner, if the molecular weight distribution Mw/Mn of the resin corresponding to the higher molecular weight side of the at least two (two or more) peaks or shoulders is 30 or less.

In the toner particles, the difference in the amount and molecular weight between the resin as a core present in the resin particle and of the resin present in the fine resin particle as a coating layer exerts a significant influence on the above-mentioned molecular weight distribution. That is, if the amount of either of the two resins is extremely large or small, or if the difference in the molecular weight is too small, the peak corresponding to one resin may be absorbed in the peak corresponding to another resin and therefore the molecular weight distribution Mw/Mn (weight average molecular weight/number average molecular weight) curve by gel permeation chromatography may not have at least two (two or more) peaks or shoulders.

In the present invention, in order to prevent offset, the molecular weight distribution Mw/Mn (weight average molecular weight/number average molecular weight) of the resin as a blend in toner is preferably at least 10 or more, and more preferably at least 15 or more.

Further, in the present invention, in order to secure the fluidity and storage stability together with the superior fixing property of the toner, it is preferable that the glass transition point of the resin component corresponding to the lower molecular weight side of the two or more peaks or shoulders (of all peaks or shoulders if there are two or more of them) should be at least 3° C. (3° C. or greater) higher than the glass transition point of the resin component corresponding to the higher molecular weight side of the two or more peaks or shoulders. Generally, the glass transition point of the resin component corresponding to the lower molecular weight side (by means of a differential scanning calorimetry and the like) is 50 to 70° C., while the glass transition point of the resin component corresponding to the higher molecular weight side (by means of a differential scanning calorimetry and the like) is 40 to 65° C.

In the second step, if the fine resin particles are used for the preparation of multicolor toner for developing an image of electrostatic charge, the surface of the flocculated particles made from the resin particles and the colorant is coated with the resin of the fine resin particles and therefore the influence of the colorant on the charging behavior can be minimized so that the difference in the properties depending on the kinds of the colorants can also be minimized. Further, if a resin having a high glass transition point is used as the fine resin particles, it is possible to secure both the fluidity and storage stability and it is also possible to prepare toner for developing an image of electrostatic charge which has a superior charging property.

As for the average particle diameter of the fine resin particle, it is preferable that the maximum be 1 μm (1 μm or less), and the diameter be within the range of 0.01 to 1 μm. If the average particle diameter is greater than 1 μm, the particle size distribution of the finally resultant toner for developing an image of electrostatic charge is broadened or isolated particles are generated, and therefore the performance and the reliability tend to drop. On the other hand, if the average diameter is within this range, the fine resin particles overcome the above-mentioned drawbacks and are advantageous in forming a layer structure by the fine resin particles. The average diameter can be measured with, for example, a Coulter counter.

The volume of the fine resin particles, which depends on the volume fraction of the obtained toner for developing an image of electrostatic charge, is preferably 50% or less of the volume of the obtained toner for developing an image of electrostatic charge. If the volume of the fine resin particles exceeds 50% of the volume of the obtained toner for developing an image of electrostatic charge, it will be difficult to secure the desired performance of the obtained toner due to increase in the fluctuation of the compositional or particle size distribution of the resultant toner for developing an image of electrostatic charge, because the fine resin particles do not adhere/flocculate to the flocculated particles but instead form new flocculated particles.

For the preparation of the dispersion liquid of the fine resin particles, a single resin may be dispersed, or two or more resins in a combination may be dispersed. In the latter case, the combination of the resins is not particularly limited and the combination can be selected appropriately depending on the purpose.

The dispersing medium of the dispersion liquid of the fine resin particles is, for example, the aforementioned aqueous medium. In the present invention, the aqueous medium preferably contains at least one surfactant.

The fine resin particle content of the dispersion liquid of the fine resin particles is usually 5 to 60% by weight, and preferably 10 to 40% by weight. If the fine resin particle content is outside this range, it may be difficult to fully control the structure and composition in the region ranging from the interior to the surface of the particle of toner for developing an image of electrostatic charge. When the flocculated particles are formed, the content of the flocculated particles in the dispersion liquid of the flocculated particles is usually 40% by weight or less.

The dispersion liquid of the fine resin particles is prepared, for example, by dispersing at least one of the aforementioned resins for the fine resin particles in an aqueous medium which contains at least one ionic surfactant. Alternately, dispersion liquid of the fine resin particles is prepared by adsorbing and fixing resin particles by means of mechanically shearing action or electrically onto the latex particles prepared by emulsion polymerization or seed polymerization.

In the second step, the combined particles are formed by adhering the fine resin particles to the flocculated particles by blending a liquid dispersion comprising dispersed fine resin particles into the dispersion liquid of flocculated particles which are prepared at the first step. Since the fine resin particles are regarded as newly adding particles to the flocculated particles, the fine resin particles are herein referred to as "adding particles" upon occasion.

The blending method is not particularly limited. For example, the adding operation may be continuous or may be divided into several steps. By such addition of the fine resin particles (adding particles), the formation of too fine particles is inhibited and it is possible to sharpen the particle size distribution of the obtained toner for developing an image of electrostatic charge. At the same time, it is possible to vary gradually the structure and composition in the region ranging from the interior to the surface of the particle of toner for developing an image of electrostatic charge and thus it is possible to easily control the structure of the toner for developing an image of electrostatic charge.

Further, it is possible to secure the fluidity and storage stability together with the superior fixing property at a lower temperature of the toner by selecting the resin for the resin particles and the fine resin particles in such a way that the glass transition point of the resin present in the exterior of the toner particle is higher than the glass transition point of the resin present in the interior of the toner particle.

Also, it is possible to prevent the offset to the heat roll by increasing the elasticity in a fused state by increasing the molecular weight of the resin on the higher molecular weight side. This is a very effective means in the case where oil coating is not implemented.

The fluidity and the transferability of toner are improved owing to the enhancement of the surface smoothness of the toner particle, if the resins are selected in such a way that the molecular weight of the resin present in the exterior of the toner particle (i.e., the resin in the fine resin particles) is larger than the molecular weight of the resin present in the interior of the toner particle (i.e., the resin in the flocculated particles). In this case, if the flocculated particles are not made from a single resin and therefore particles of two or more resins are flocculated, the molecular weight of the resin present on the interior of the toner particle (i.e., the resin in the flocculated particles) means an average of the molecular weights of all resins contained in the flocculated particles.

If the molecular weight of the resin present in the exterior of the toner particle differs extremely from the molecular weight of the resin present in the interior of the toner particle, the adhesion between the core and the coating layer of the obtained toner particle may decrease. In this case, the toner particles can be destroyed if a mechanical stress is applied to the toner particles by agitation or by blending thereof with carrier particles in a developing device. Accordingly, when the fine resin particles are adhered to the flocculated particles, it is possible to employ a procedure comprising firstly adhering fine resin particles, which have a molecular weight and/or glass transition point midway between those of the resin present in the exterior of the toner particle and those of the resin present in the interior of the toner particle, to the flocculated particles and thereafter adhering selected fine resin particles to the flocculate particles. It should be noted, however, that also in this case the curve of molecular weight distribution by gel permeation chromatography which is stated previously needs to have at least two peaks or shoulders. The reason for this requirement is as stated previously.

If the addition of the fine resin particles is performed over several stages, it is possible to create a gradient of structural and compositional change in the region ranging from the interior to the exterior of the toner particle for developing an image of electrostatic charge, because this mode of addition makes it possible to stack the layers of the fine resin particles stepwise on the surface of the flocculated particles. By this procedure, it is also possible to increase the surface hardness of the toner particles. Further, it is possible to maintain the particle size distribution, to inhibit the fluctuation of the distribution, to dispense with the use of a stabilizing agent such as a surfactant, base or acid designed for the improvement of the fusion stability at the third step for fusion, or to minimize the amount of such additives used. Consequently, this procedure is advantageous in cost reduction and quality improvement.

The operational conditions for adhering the fine resin particles to the flocculated particles are described below.

The temperature is lower than the glass transition point of the resin in the resin particles of the first step, and the temperature is preferably about room temperature. If heating is performed at a temperature lower than the glass transition point, the adhesion between the flocculated particles and the fine resin particles is enhanced and therefore the combined particles which are formed become more stable.

Although the treating time depends on the temperature, the treating time is usually 5 minutes to about 2 hours.

In the adhering operation, the dispersion liquid containing the flocculated particles and the fine resin particles maybe in a stationary state or maybe gently agitated by means of a mixer or the like. The implementation of agitation is advantageous, because uniformly combined particles are more easily produced.

In the present invention, the second step may be performed once or many times. In the former case, a single layer of the fine resin particles (adding particles) is formed on the surface of the flocculated particles. However, in the latter case, if two or more kinds of the dispersion liquids of the fine resin particles are employed, two or more kinds of layers of the fine resin particles (adding particles) contained in these dispersion liquids of the fine resin particles are laminated on the surface of the flocculated particles. Therefore, the latter case is more advantageous, because it enables one to produce toner having a complicated and precisely structured stratum for developing an image of electrostatic charge and to impart desired functions to the toner for developing an image of electrostatic charge.

If the second step is repeated a number of times, the kinds of the fine resin particles to be combined with the flocculated particles at the first addition and at the second addition or later may be selected at will depending on, for example, the use of the toner for developing an image of electrostatic charge.

If the second step is carried out a number of times, it is preferable to heat the dispersion liquid containing the fine resin particles and the flocculated particles to a temperature lower than the glass transition point of the resin in the resin particles of the first step, and it is more preferable to raise the heating temperature stepwise. This procedure makes it possible to prevent the formation of isolated particles.

As stated above, the second step produces combined particles by adhering the fine resin particles into the flocculated particles prepared in the first step. If the second step is carried out a number of times, the fine resin particles are adhered a number of times to the flocculated particles of the first step to form the combined particles. Accordingly, by selecting the fine resin particles to be adhered to the flocculated particles in the second step, it is possible to appropriately design and produce a toner having desired properties for developing an image of electrostatic charge.

Third step

The third step consists of fusing the combined particles by heating to prepare toner particles by heating (hereinafter the third step is referred to as "a fusion step" upon occasion).

The heating temperature in the range of from the glass transition point to the decomposition temperature of the resin contained in the combined particles. Accordingly, although the heating temperature varies depending on the kinds of the resins in the resin particles and in the fine resin particles, the heating temperature is generally in the range of from the glass transition point of the resin contained in the combined particles to 180° C. The heating can be performed with known heaters and devices.

Although the fusion time varies depending on the heating temperature such that the time is shorter if the heating temperature is higher and the time is longer if the heating temperature is lower, the fusion time is usually from 30 minutes to 10 hours.

In the present invention, after the completion of the third step, the obtained toner for developing an image of electrostatic charge can be washed and thereafter dried under appropriate conditions. The surface of the obtained toner for developing an image of electrostatic charge may be added with inorganic particles, such as silica, alumina, titania and calcium carbonate, or with particles of resins, such as vinyl resins, polyester resins and silicone resins, in a dry state by means of a shearing force. These inorganic particles and particles of resins function as external additives to improve the fluidity or cleanability of the toner.

As stated above, the third step performs the fusion of the combined particles of the second step while maintaining the structure of the combined particles in which the fine resin particles (adding particles) adhere to the surface of the flocculated particles (mother particles), and in this way the toner for developing an image of electrostatic charge is prepared.

The thus obtained toner for developing an image of electrostatic charge is advantageous in that the minimum fixing temperature is reduced and that the offset is effectively prevented, because the molecular weight distribution curve of the resin contained in the toner by gel permeation chromatography exhibits at least two peaks or shoulders.

toner for developing an image of electrostatic charge

The toner for developing an image of electrostatic charge according to the present invention is prepared by the above-described method of the present invention for preparing the toner for developing an image of electrostatic charge.

The toner particle for developing an image of electrostatic charge has a structure in which the flocculated particle serves as a mother particle and a coating layer comprising the fine resin particles is formed on the surface of the mother particles. The layer of the fine resin particles may consist of a single layer or may consist of two or more layers. Generally, the number of layers is equal to the number of times the operation of the second step in the method for preparing the toner for developing an image of electrostatic charge of the present invention is carried out.

The toner for developing an image of electrostatic charge has a structure in which the composition, physical property and the like change continuously or discontinuously in the region ranging from the interior to the exterior of the toner particle wherein the change is controlled within a desired range and the molecular weight distribution curve of the resin in the toner by gel permeation chromatography exhibits at least two peaks or shoulders. Therefore, the toner is superior in properties such as chargeability, developability, fixability, cleanability and particularly in chargeability. Further, the toner has a high reliability, because it maintains and exhibits the above-mentioned properties and particularly the chargeability without being influenced by environmental conditions.

Since the toner for developing an image of electrostatic charge is prepared by the above-described method of the present invention for preparing the toner for developing an image of electrostatic charge, the thus prepared toner has a small average particle diameter and the particle size distribution is sharp unlike the toner prepared by a blending/pulverizing process or the like.

The average particle diameter is preferably 2 to 9 μm and more preferably 3 to 8 μm. If the average particle diameter is less than 2 μm, the chargeability tends to be insufficient and the developability tends to drop, whereas if the average particle diameter exceeds 9 μm, the resolution of the image may drop.

As an indicator of the particle size distribution, a volume average particle size distribution index (GSDv) and a number average particle size distribution index (GSDp) can be used. These indices can be simply expressed by using D16% and D84% in cumulative distribution, wherein the volume average particle size distribution index (GSDv) is expressed in $(\text{volume D84\%/volume D16\%})^{0.5}$ and the number average particle size distribution index (GSDp) is expressed in $(\text{number D84\%/number D16\%})^{0.5}$.

Based on the divided regions (channels) of particles sizes in a particle size distribution obtained by use of an instrument such as a Coulter counter TAII (manufactured by Nikkaki Co., Ltd.) or Multisizer II (manufactured by Nikkaki Co., Ltd.), cumulative distributions of volume and number are depicted each starting from the side of small particle size. The particle diameter where a cumulative percentage of 16% is attained is defined as volume D16% or number D16%, the particle diameter where a cumulative percentage of 50% is attained is defined as volume D50% or number D50%, and the particle diameter where a cumulative percentage of 84% is attained is defined as volume D84% or number D84%. The foregoing volume average particle size distribution index (GSDv) and the number average particle size distribution index (GSDp) are calculated by using the above-mentioned D16% and D84% in the cumulative distribution.

The volume GSD is preferably 1.30 or less, and more preferably 1.27 or less. If the volume GSD exceeds 1.30, the developability may become worse with time due to, for example, selective development.

The toner for developing an image of electrostatic charge, which is prepared by the above-described method of the present invention for preparing the toner for developing an image of electrostatic charge, has an average shape coefficient of toner (square of the length of the periphery of the toner particle/projected area) in the range of from 105 to 140, and more preferably in the range of from 105 to 130. In the toner for developing an image of electrostatic charge according to the present invention, the objective of the present invention can be achieved even if the shape of the toner for developing an image of electrostatic charge is somewhat irregular, so long as the molecular weight distribution curve of the resin in the toner by gel permeation chromatography exhibits at least two peaks or shoulders. However, the objective of the present invention can be more effectively achieved as the shape of the toner particle for developing an image of electrostatic charge approaches a sphere (true sphere).

The above-mentioned average shape coefficient of toner (square of the length of the periphery of the toner particle/projected area) can be calculated by, for example, the following procedure. The toner particles are spread over a sheet of slide glass, the images of the toner particles observed under an optical microscope are loaded into a Luzex image analyzer by means of a video camera, and the square of the length of the periphery of the toner particle/ projected area ($ML^2/A$) is calculated for 50 or more toner particles to obtain the average.

The charge amount of the toner for developing an image of electrostatic charge is preferably 10 to 40$\mu$C/g, and is preferably 15 to 35 $\mu$C/g. If the charge amount is less than 10 $\mu$C/g, background staining tends to occur, whereas if the charge amount exceeds 40 $\mu$C/g, reduction in image density tends to occur.

The ratio of the charge amount in summer to the charge amount in winter of the toner for developing an image of electrostatic charge is preferably 0.5 to 1.5, and more preferably 0.7 to 1.3. If the ratio is outside this range, the stability level of the chargeability may not fulfill practical requirements due to the dependence of the toner on environmental conditions.

developer for an image of electrostatic charge

A developer for an image of electrostatic charge can be obtained by combining the toner for developing an image of electrostatic charge and a carrier.

The carrier to be used herein is not particularly limited and is a known carrier. For example, the carrier described in, for example, JP-A Nos.62-39,879and56-11,461, can be used.

In the developer for an image of electrostatic charge, the mixing ratio of the toner for developing an image of electrostatic charge according to the present invention and the carrier is not particularly limited and can be appropriately selected depending on the objective.

method for forming an image

The method for forming an image according to the present invention includes a step for forming a latent image of electrostatic charge, a step for forming a toner image, and a step for transferring the toner image, in which these steps a are generally known and are described in, for example, JP-A Nos.56-40,868 and 49-91,231. The method for forming an image according to the present invention can be performed by use of an image forming apparatus such as a copying machine or a facsimile which are themselves known.

The step for forming a latent image of electrostatic charge consists in the formation of a latent image of electrostatic charge on an electrostatic latent image carrier. The step for forming a toner image consists in the formation of a toner image by developing the electrostatic latent image by use of a developer layer on a developer carrier. The developer layer is not particularly limited, only if it contains a developer comprising toner for developing an image of electrostatic charge according to the present invention. The step for transferring the toner image consists in transferring the toner image onto an image receiving medium.

The method for forming an image according to the present invention preferably includes a cleaning step, and more preferably includes a recycling step.

The cleaning step consists in recovering the excess toner for developing an image of electrostatic charge at the time when a toner image is formed. The recycling step consists in carrying the toner for developing an image of electrostatic charge recovered in the cleaning step to a developer layer.

The process which include the cleaning step and the recycling step can be performed by use of an image forming apparatus such as a copying machine or facsimile equipped with a toner recycling system. The method for forming an image may adopt a recycle system in which the cleaning step is omitted and the toner is recovered simultaneously with the developing operation.

The present invention will be further clarified by the following examples, which should not be viewed as a limitation on any embodiment of the invention.

EXAMPLE 1 first step

Preparation of dispersion liquid (1)

| | |
|---|---|
| Styrene | 360 g |
| n-butyl acrylate | 40 g |
| Acrylic acid | 8 g |
| Dodecanethiol | 16 g |
| Carbon tetrabromide | 3 g |

A mixture comprising the above components was dispersed and emulsified in 500 g of ion-exchanged water containing 9 g of a nonionic surfactant (Emulgen 840 manufactured by Kao Corporation) and 10 g of an anionic surfactant (Neogen SC manufactured by Daiichi Kogyo Seiyaku Co., Ltd.) in a flask, which was then gently agitated for 10 minutes and admixed with 100 g of ion-exchanged water containing 4 g of ammonium persulfate and thereafter the flask interior was purged with a nitrogen gas. The contents were continuously agitated gently and were heated to 70° C. by means of an oil bath, and the emulsion polymerization was continued in this state for 6 hours.

In the above-described way, there was prepared a dispersion liquid (1) which had an average particle diameter of 160 nm and which comprised particles of a resin having a glass transition point of 59° C., a weight average molecular weight (Mw) of 16,200 and a molecular weight distribution (Mw/Mn) of 3.20.

Preparation of dispersion liquid (2)

| | |
|---|---|
| Styrene | 280 g |
| n-butyl acrylate | 120 g |
| Acrylic acid | 8 g |

A solution comprising the above was dispersed and emulsified in 500 g of ion-exchanged water containing 9 g of a nonionic surfactant (Emulgen 840 manufactured by Kao Corporation) and 12 g of an anionic surfactant (Neogen SC manufactured by Daiichi Kogyo Seiyaku Co., Ltd.) in a flask, which was then gently agitated for 10 minutes and admixed with 100 g of ion-exchanged water containing 2 g of ammonium persulfate and thereafter the flask interior was purged with a nitrogen gas. The contents were continuously agitated and were heated to 70° C. by means of an oil bath, and the emulsion polymerization was continued in this state for 6 hours. In the above-described way, there was prepared a dispersion liquid (2) which had an average particle diameter of 95 nm and which comprised particles of a resin having a glass transition point of 54° C., a weight average molecular weight (Mw) of 700,000 and a molecular weight distribution (Mw/Mn) of 10.5.

Preparation of a dispersion liquid of colorant (1)

| | |
|---|---|
| Carbon black (Regal 300 manufactured by Cabot corporation) | 50 g |
| Nonionic surfactant (Nonipole 400 manufactured by Sanyo Chemical Industries, Ltd.) | 5 g |
| Ion-exchanged water | 200 g |

A mixture of the above was dispersed by means of a homogenizer (Ultratalax manufactured by IKA Co., Ltd.) for 10 minutes and a dispersion liquid of colorant (1) which comprised a dispersed colorant (carbon black) having an average particle size of 250 nm was prepared.

Preparation of a dispersion liquid of release agent (1)

| | |
|---|---|
| Paraffin wax (HNP0190, having a melting point of 85° C., manufactured by Nippon Seiro Co., Ltd.) | 50 g |
| Cationic surfactant (Sanizole B50 manufactured by Kao Corporation) | 5 g |
| Ion-exchanged water | 200 g |

A mixture of the above was heated to 95° C. The mixture was dispersed by means of a homogenizer (Ultratalax T50 manufactured by IKA Co., Ltd.) and was further dispersed by means of a pressure-ejection type homogenizer. In this way, a dispersion liquid of release agent (1) which comprised a dispersed release agent having an average particle size of 550 nm was prepared.

Preparation of flocculated particles

| | |
|---|---|
| Dispersion liquid (1) | 120 g |
| Dispersion liquid (2) | 70 g |
| Dispersion liquid of colorant (1) | 30 g |
| Dispersion liquid of release agent (1) | 40 g |
| Cationic surfactant (Sanizole B50 manufactured by Kao Corporation) | 1.5 g |

A mixture of the above was placed in a round-bottom stainless steel flask and was dispersed by means of a homogenizer (Ultratalax T50 manufactured by IKA Co., Ltd.). The contents were heated to 48° C. by means of an oil bath while the contents were stirred and were then kept at 50° C. for 30 minutes. The results of the observation by means of an optical microscope confirmed the formation of flocculated particles having an average particle size of about 5.5 $\mu$m (volume: 85 $cm^3$)

second step

Preparation of combined particles

Then, to the above prepared dispersion kept at 50° C. was added 50 g of the dispersion liquid (1) as a dispersion of fine resin particles, which contained 20 $cm^3$ of the fine resin particles. The temperature of the oil bath was further kept at 50° C. for 1 hour.

The results of the observation by means of an optical microscope confirmed the formation of combined particles having an average particle size of about 6.0 $\mu$m.

third step

After that, to the above prepared dispersion kept at 50° C. was added 25 g of an aqueous solution (20% solution of an anionic surfactant) containing 5 g of an anionic surfactant (Neogen SC manufactured by Daiichi Kogyo Seiyaku Co., Ltd.). Then, the stainless steel flask was hermetically sealed and the contents were heated to 110° C., while being stirred by means of a magnetic seal, and were held at that temperature for 2 hours.

The contents were then cooled down, filtered, washed sufficiently with ion-exchanged water and dried by means of a hot air dryer. In this way, toner for developing an image of electrostatic charge was obtained.

Evaluation

The average particle diameter of the thus obtained toner for developing an image of electrostatic charge was measured by means of a Coulter counter, and a value of 6.2 $\mu$m was obtained. Further, volume GSD as an indicator of the particle size distribution by volume was measured, and a value of 1.22 was obtained.

The molecular weight distribution of the resin in the obtained toner for developing an image of electrostatic charge was measured by means of a gel permeation chromatograph (HLC8120 manufactured by TOSO Co., Ltd.). The obtained curve exhibited two peaks at weight average molecular weights of 15,000 and 600,000 and an overall molecular weight distribution Mw/Mn of 36.0. According to the results of the observation of the surface state by means of an electron microscope, the exposure of a waxy substance to the surface of the toner particle for developing an image of electrostatic charge was very slight and the amount of isolated waxy substance was very small.

The enlarged images of the toner particles observed under an optical microscope were loaded into an image analyzer, and a toner shape coefficient (the square of the length of the periphery of the toner particle/projected area) was calculated for a sample of about 200 toner particles. In this way, a value of 128.5 was obtained.

Absolutely no blocking was observed when the toner for developing an image of electrostatic charge was kept at 45° C. for 24 hours.

Then, 0.8 parts by weight of hydrophobic silica (TS720 manufactured by Cabot Corporation) was added to 100 parts by weight of the toner for developing an image of electrostatic charge, and the mixture was blended by means of a sample mill. A developer for an image of electrostatic charge was then prepared by a procedure comprising weighing into a glass bottle the toner obtained above and ferrite carrier which had an average particle diameter of 50 $\mu$m and was coated with 1% of polymethyl methacrylate (manufactured by Soken Chemical Co., Ltd.) such that the a toner concentration of 5% by weight was obtained, and thereafter blending the mixture by means of a V-shaped blender.

The performance of the toner for developing an image of electrostatic charge was evaluated by a modified version of V500 copying machine (manufactured by Fuji Xerox Co., Ltd.). Fixability was satisfactory at a heat roll temperature of 132° C. as assessed by the durability tester utilizing abrasion with a waste cloth. No offset was observed up to 235° C.

The produced image was stable and no filming phenomenon was observed on the photoreceptor when a continuous copying test of 10,000 copies was conducted. The efficiency of the toner transfer from the photoreceptor to the image receiving paper during the continuous copying test was as high as 93 to 96%.

Comparative Example 1

Preparation of dispersion liquid (3)

| | |
|---|---|
| Styrene | 280 g |
| n-butyl acrylate | 120 g |
| Acrylic acid | 8 g |

A solution comprising the above was dispersed and emulsified in 500 g of ion-exchanged water containing 9 g of a nonionic surfactant (Emulgen 840 manufactured by Kao Corporation) and 12 g of an anionic surfactant (Neogen SC manufactured by Daiichi Kogyo Seiyaku Co., Ltd.) in a flask, which was then gently agitated for 10 minutes and admixed with 100 g of ion-exchanged water containing 6 g of ammonium persulfate and thereafter the flask interior was purged with a nitrogen gas. The contents were continuously agitated gently and were heated to 70° C. by means of an oil bath, and the emulsion polymerization was continued in this state for 6 hours.

In the above-described way, there was prepared a dispersion liquid (3) which had an average particle diameter of 110 nm and which comprised particles of a resin having a glass transition point of 52° C., a weight average molecular weight (Mw) of 220,000 and a molecular weight distribution (Mw/Mn) of 12.8.

Preparation of flocculated particles

| | |
|---|---|
| Dispersion liquid (1) | 120 g |
| Dispersion liquid (3) | 35 g |
| Dispersion liquid of colorant (1) | 30 g |
| Dispersion liquid of release agent (1) | 40 g |
| Cationic surfactant (Sanizole B50 manufactured by Kao Corporation) | 1.5 g |

A mixture of the above was placed in a round-bottom stainless steel flask and was dispersed by means of a homogenizer (Ultratalax T50 manufactured by IKA Co., Ltd.). The contents were heated to 48° C. by means of an oil bath while the contents were stirred and were then kept at 50° C. for 30 minutes. The results of the observation by means of an optical microscope confirmed the formation of flocculated particles having an average particle size of about 5.4 $\mu$m (volume: 74 $cm^3$).

Then, to the above prepared dispersion kept at 50° C. was added 50 g of the dispersion liquid (1) as a dispersion of fine resin particles, which contained 20 $cm^3$ of the fine resin particles. The temperature of the oil bath was further kept at 50° C. for 1 hour.

The results of the observation by means of an optical microscope confirmed the formation of combined particles having an average particle size of about 5.8 $\mu$m.

After that, to the above prepared dispersion kept at 50° C. was gradually added 25 g of an aqueous solution (20% solution of an anionic surfactant) containing 5 g of an anionic surfactant (Neogen SC manufactured by Daiichi Kogyo Seiyaku Co., Ltd.). Then, the stainless steel flask was hermetically sealed and the contents were heated to 110° C., while being stirred by means of a magnetic seal, and were held at that temperature for 2 hours.

The contents were then cooled down, filtered, washed sufficiently with ion-exchanged water, filtered and dried by means of a hot air dryer. In this way, toner for developing an image of electrostatic charge was obtained.

Evaluation

The average particle diameter of the thus obtained toner for developing an image of electrostatic charge was measured by means of a Coulter counter, and a value of 6.0 $\mu$m was obtained. Further, volume GSD as an indicator of the particle size distribution by volume was measured, and a value of 1.22 was obtained.

The molecular weight distribution of the resin in the obtained toner for developing an image of electrostatic charge was measured by means of a gel permeation chromatograph (HLC8120 manufactured by TOSO Co., Ltd.). The obtained curve exhibited only one peak in a region of a weight average molecular weight of about 20,000 and exhibited no shoulder. The overall molecular weight distribution Mw/Mn was 9.6.

The enlarged images of the toner particles observed under an optical microscope were loaded into an image analyzer, and a toner shape coefficient (square of the length of the periphery of the toner particle/projected area) was calculated for about 200 toner particles sampled. In this way, a value of 122.0 was obtained.

Then, 0.8 parts by weight of hydrophobic silica (TS720 manufactured by Cabot Corporation) was added to 100 parts by weight of the toner for developing an image of electrostatic charge, and the mixture was blended by means of a sample mill. A developer for an image of electrostatic charge was then prepared by a procedure comprising weighing into a glass bottle the toner obtained above and ferrite carrier which had an average particle diameter of 50 $\mu$m and was coated with 1% of polymethyl methacrylate (manufactured by Soken Chemical Co., Ltd.) such that the a toner concentration of 5% by weight was obtained, and thereafter blending the mixture by means of a V-shaped blender.

The performance of the toner for developing an image of electrostatic charge was evaluated by a modified version of V500 copying machine (manufactured by Fuji Xerox Co., Ltd.). Fixability was satisfactory at a heat roll temperature of 130° C. as assessed by the durability tester utilizing abrasion with a waste cloth. However, significant offset occurred at 170° C., and thus the offset resistance of Comparative Example 1 was markedly inferior to that of Example 1.

EXAMPLE 2 first step

Preparation of dispersion liquid (4)

| | |
|---|---|
| Styrene | 340 g |
| n-butyl acrylate | 60 g |
| Acrylic acid | 8 g |
| Dodecanethiol | 12 g |
| Carbon tetrabromide | 4 g |

A mixture comprising the above was dispersed and emulsified in 500 g of ion-exchanged water containing 9 g of a nonionic surfactant (Emulgen 840 manufactured by Kao Corporation) and 10 g of an anionic surfactant (Neogen SC manufactured by Daiichi Kogyo Seiyaku Co., Ltd.) in a flask, which was then gently agitated for 10 minutes and admixed with 100 g of ion-exchanged water containing 4 g of ammonium persulfate and thereafter the flask interior was purged with nitrogen gas. The contents were continuously agitated and were heated to 70° C. by means of an oil bath, and the emulsion polymerization was continued in this state for 6 hours.

In the above-described way, there was prepared a dispersion liquid (4) which had an average particle diameter of 160 nm and which comprised particles of a resin having a glass transition point of 58° C., a weight average molecular weight (Mw) of 19,500 and a molecular weight distribution (Mw/Mn) of 2.95.

Preparation of flocculated particles

| | |
|---|---|
| Dispersion liquid (4) | 100 g |
| Dispersion liquid (2) | 50 g |
| Dispersion liquid of colorant (1) | 30 g |
| Cationic surfactant (Sanizole B50 manufactured by Kao Corporation) | 1.5 g |

A mixture of the above was placed in a round-bottom stainless steel flask and was dispersed by means of a homogenizer (Ultratalax T50 manufactured by IKA Co., Ltd.). The contents were heated to 48° C. by means of an oil bath while the contents were stirred, and were then kept at 50° C. for 30 minutes. The results of the observation by means of an optical microscope confirmed the formation of flocculated particles having an average particle size of about 5.4 $\mu$m (volume: 63 $cm^3$).

second step

Preparation of combined particles

Then, to the above prepared dispersion kept at 50° C. was gently added 50 g of the dispersion liquid (4) as a dispersion of fine resin particles, which contained 21 $cm^3$ of the fine resin particles. The temperature of the oil bath was further kept at 50° C. for 30 minutes.

The results of the observation by means of an optical microscope confirmed the formation of combined particles having an average particle size of about 5.8 μm.

Furthermore, to the above prepared dispersion kept at 50° C. was gently added 50 g of the dispersion liquid (1) as a dispersion of fine resin particles, which contained 20 $cm^3$ of the fine resin particles. The temperature of the oil bath was kept at 52° C. for a further 30 minutes.

The results of the observation by means of an optical microscope confirmed the formation of combined particles having an average particle size of about 6.2 μm.

third step

After that, to the above prepared dispersion kept at 50° C. was added 25 g of an aqueous solution (20% solution of an anionic surfactant) containing 5 g of an anionic surfactant (Neogen SC manufactured by Daiichi Kogyo Seiyaku Co., Ltd.). Then, the stainless steel flask was hermetically sealed and the contents were heated to 110° C., while being stirred by means of a magnetic seal, and were held at that temperature for 2 hours.

The contents were then cooled down, filtered, washed sufficiently with ion-exchanged water, filtered and dried by means of a hot air dryer. In this way, toner for developing an image of electrostatic charge was obtained.

Evaluation

The average particle diameter of the thus obtained toner for developing an image of electrostatic charge was measured by means of a Coulter counter, and a value of 6.3 μm was obtained. Further, volume GSD as an indicator of the particle size distribution by volume was measured, and a value of 1.21 was obtained.

As a result, toner for developing an image of electrostatic charge was obtained which had a particle structure in which, from the center to the surface of the toner particle, the molecular weight of resin gradually decreased and the glass transition point of resin gradually became higher.

The molecular weight distribution of the resin in the obtained toner for developing an image of electrostatic charge was measured by means of a gel permeation chromatograph (HLC8120 manufactured by TOSO Co., Ltd.). The obtained curve exhibited two large shoulders in regions of weight average molecular weights of 15,000 and 600,000 and an overall molecular weight distribution Mn/Mn of 37.0. According to the results of the observation of the surface state by means of an electron microscope, the exposure of a waxy substance to the surface of the toner particle for developing an image of electrostatic charge was very slight and absolutely no isolated waxy substance was observed.

The enlarged images of the toner particles observed under an optical microscope were loaded into an image analyzer, and an average of toner shape coefficient (square of the length of the periphery of the toner particle/projected area) was calculated for a sample of about 200 toner particles. In this way, a value of 127.0 was obtained.

Absolutely no blocking was observed when the toner for developing an image of electrostatic charge was kept at 45° C. for 24 hours.

Then, 0.8 parts by weight of hydrophobic silica (TS720 manufactured by Cabot Corporation) was added to 100 parts by weight of the toner for developing an image of electrostatic charge, and the mixture was blended by means of a sample mill. A developer for an image of electrostatic charge was then prepared by a procedure comprising weighing into a glass bottle the toner obtained above and a ferrite carrier which had an average particle diameter of 50 μm and was coated with 1% of polymethyl methacrylate (manufactured by Soken Chemical Co., Ltd.) such that the a toner concentration of 5% by weight was obtained, and thereafter blending the mixture for 5 minutes by means of a ball mill.

The performance of the toner for developing an image of electrostatic charge was evaluated by a modified version of a V500 copying machine (manufactured by Fuji Xerox Co., Ltd.). The produced image was stable and no filming phenomenon was observed on the photoreceptor when a continuous copying test of 50,000 copies was conducted. The efficiency of the toner transfer from the photoreceptor to the image receiving paper during the continuous copying test was as high as 94 to 97%.

Then, the performance of the toner of Example 2 was compared with that of Example 1 in the same condition of a toner concentration of 5% by weight on the ferrite carrier by conducting a blank test which comprised stirring the developer without the replenishment of the toner for ten hours in the modified version of the V500 copying machine. In the case of the toner for developing an image of electrostatic charge of Example 1, the increase of fine particles having a diameter of 3 μm or less was 2.2% (based on number), whereas in the case of the toner for developing an image of electrostatic charge of Example 2, the increase of fine particles having a particles diameter of 3 μm or less was only 0.7%.

EXAMPLE 3 first step

Preparation of dispersion liquid (5)

| | | |
|---|---|---|
| Styrene | 340 | g |
| n-butyl acrylate | 60 | g |
| Acrylic acid | 8 | g |
| Dodecanethiol | 12 | g |
| Carbon tetrabromide | 4 | g |

A mixture comprising the above was dispersed and emulsified in 500 g of ion-exchanged water containing 9 g of a nonionic surfactant (Emulgen 840 manufactured by Kao Corporation) and 10 g of an anionic surfactant (Neogen SC manufactured by Daiichi Kogyo Seiyaku Co., Ltd.) in a flask, which was then gently agitated for 10 minutes and admixed with 100 g of ion-exchanged water containing 4 g of ammonium persulfate and thereafter the flask interior was purged with nitrogen gas. The contents were continuously agitated and were heated to 70° C. by means of an oil bath, and the emulsion polymerization was continued in this state for 6 hours.

In the above-described way, there was prepared a dispersion liquid (5) which had an average particle diameter of 170 nm and which comprised particles of a resin having a glass transition point of 54° C., a weight average molecular weight (Mw) of 21,000 and a molecular weight distribution (Mw/Mn) of 3.10.

Preparation of dispersion liquid (6)

| | | |
|---|---|---|
| Styrene | 260 | g |
| n-butyl acrylate | 140 | g |
| Acrylic acid | 8 | g |

A solution comprising the above was dispersed and emulsified in 500 g of ion-exchanged water containing 9 g of a nonionic surfactant (Emulgen 840 manufactured by Kao Corporation) and 12 g of an anionic surfactant (Neogen SC manufactured by Daiichi Kogyo Seiyaku Co., Ltd.) in a flask, which was then gently agitated for 10 minutes and admixed with 100 g of ion-exchanged water containing 2 g of ammonium persulfate and thereafter the flask interior was purged with nitrogen gas. The contents were continuously agitated and were heated to 70° C. by means of an oil bath, and the emulsion polymerization was continued in this state for 6 hours.

In the above-described way, there was prepared a dispersion liquid (6) which had an average particle diameter of 95 nm and which comprised particles of a resin having a glass transition point of 50° C., a weight average molecular weight (Mw) of 750,000 and a molecular weight distribution (Mw/Mn) of 12.0.

Preparation of a dispersion liquid of colorant (2)

| | | |
|---|---|---|
| Copper phthalocyanine pigment (manufactured by BASF Corporation) | 100 | g |
| Nonionic surfactant (Nonipole 400 manufactured by Sanyo Chemical Industries, Ltd.) | 5 | g |
| Ion-exchanged water | 200 | g |

A mixture of the above was dispersed by means of a rotator/stator type homogenizer (Ultratalax manufactured by IKA Co., Ltd.) for 10 minutes and was further dispersed for 5 minutes by means of an ultrasonic homogenizer. In this way, a dispersion liquid of colorant (2) which comprised a dispersed colorant (copper phthalocyanine) having an average particle size of 150 nm was prepared.

Preparation of flocculated particles

| | | |
|---|---|---|
| Dispersion liquid (5) | 170 | g |
| Dispersion liquid (6) | 30 | g |
| Dispersion liquid of colorant (2) | 15 | g |
| Dispersion liquid of release agent (1) | 20 | g |
| Cationic surfactant (Sanizole B50 manufactured by Kao Corporation) | 1.5 | g |

A mixture of the above was placed in a round-bottom stainless steel flask and was dispersed by means of a homogenizer (Ultratalax T50 manufactured by IKA Co., Ltd.). The contents were heated to 45° C. by means of an oil bath while the contents were stirred, and were then kept at 45° C. for 30 minutes. The results of the observation by means of an optical microscope confirmed the formation of flocculated particles having an average particle size of about 5.0 $\mu$m (volume: 85 $cm^3$).

second step

Preparation of combined particles

Then, to the above prepared dispersion kept at 45° C. was gently added 50 g of the dispersion liquid (4) as a dispersion of fine resin particles, which contained 21 $cm^3$ of the fine resin particles. The temperature of the oil bath was raised to 47° C. and was kept at that temperature for 1 hour.

The results of the observation by means of an optical microscope confirmed the formation of combined particles having an average particle size of about 5.5 $\mu$m.

third step

After that, to the above prepared dispersion kept at 47° C. was added 5 g of an anionic surfactant (Neogen SC manufactured by Daiichi Kogyo Seiyaku Co., Ltd.). Then, the stainless steel flask was hermetically sealed and the contents were heated to 100° C., while being stirred by means of a magnetic seal, and were held at that temperature for 2 hours. The contents were then cooled down, filtered, washed sufficiently with ion-exchanged water, filtered and dried by means of a hot air dryer. In this way, toner for developing an image of electrostatic charge was obtained.

Evaluation

The average particle diameter of the thus obtained toner for developing an image of electrostatic charge was measured by means of a Coulter counter, and a value of 5.7 $\mu$m was obtained. Further, volume GSD as an indicator of the particle size distribution by volume was measured, and a value of 1.20 was obtained.

The molecular weight distribution of the resin in the obtained toner for developing an image of electrostatic charge was measured by means of a gel permeation chromatograph (HLC8120 manufactured by TOSO Co., Ltd.). The obtained curve exhibited two shoulders at weight average molecular weights of 20,000 and 50,000 and an overall molecular weight distribution Mw/Mn of 12.0. According to the results of the observation of the surface state by means of an electron microscope, the exposure of a waxy substance to the surface of the toner particle for developing an image of electrostatic charge was very slight and the amount of isolated waxy substance was very small.

The enlarged images of the toner particles observed under an optical microscope were loaded into an image analyzer, and a toner shape coefficient (square of the length of the periphery of the toner particle/projected area) was calculated for a sample of about 200 toner particles. In this way, a value of 112.0 was obtained.

Then, 1.0 part by weight of hydrophobic silica (TS720 manufactured by Cabot Corporation) was added to 100 parts by weight of the toner for developing an image of electrostatic charge, and the mixture was blended by means of a sample mill. A developer for an image of electrostatic charge was then prepared by a procedure comprising weighing into a glass bottle the toner obtained above and a ferrite carrier with an average particle diameter of 50 $\mu$m and coated with 1% of polymethyl methacrylate (manufactured by Soken Chemical Co., Ltd.) such that a toner concentration of 5% by weight was obtained, and thereafter blending the mixture for 5 minutes by means of a ball mill.

The performance of the toner for developing an image of electrostatic charge was evaluated by a modified version of V500 copying machine (manufactured by Fuji Xerox Co., Ltd.). Fixability was satisfactory at a heat roll temperature of 125° C. as assessed by the durability tester utilizing abrasion with a waste cloth. The image was a glossy cyan image. No offset was observed up to 190° C. In the continuous copying test by use of the modified version of a V500 copying machine, the produced image was stable and no filming phenomenon was observed on the photoreceptor when a continuous copying test of 10,000 copies was conducted. The efficiency of the toner transfer from the photoreceptor to the image receiving paper during the continuous copying test was as high as 95 to 98%.

EXAMPLE 4

Two kinds of toner, namely a first toner and a second toner, for developing an image of electrostatic charge having an average shape coefficient different from that of the toner for developing an image of electrostatic charge of Example 3 were prepared by employing the same compositional condition as in Example 3 but employing a heating condition of 110° C. for 3 hours for the first toner after flocculation and employing a heating condition of 90° C. for 2 hours for the second toner after flocculation. The average shape coefficient for the first toner was 104.0 (nearly a perfect sphere), while the average shape coefficient for the second toner was 135.0 (irregular).

Then, as in Example 3, 1.0 part by weight of hydrophobic silica (TS720 manufactured by Cabot Corporation) was added to 100 parts by weight of each of the toners for developing an image of electrostatic charge, and the mixture was blended by means of a sample mill. A developer for an image of electrostatic charge was then prepared by a procedure comprising weighing into a glass bottle each of the toner obtained above and a ferrite carrier which had an average particle diameter of 50 μm and was coated with 1% of polymethyl methacrylate (manufactured by Soken Chemical Co., Ltd.) such that a toner concentration of 5% by weight was obtained, and thereafter blending the mixture for 5 minutes by means of a ball mill.

The performance of each of the toners for developing an image of electrostatic charge was evaluated by a modified version of a V500 copying machine (manufactured by Fuji Xerox Co., Ltd.). By the durability tester utilizing abrasion with a waste cloth, fixability was found to be nearly equal to that of the toner of Example 3. In the continuous copying test by use of the modified version of a V500 copying machine, the performance of the first toner was inferior to that of the toner of Example 3 because the first toner led to inferior cleaning. In the case of the second toner, after taking 10,000 copies, staining of the background occurred and a slight filming phenomenon on the photoreceptor was also observed. These results, however, were judged to present no problem to practical use. In the continuous copying test, the efficiency of the toner transfer from the photoreceptor to the image receiving paper during the continuous copying test was 88 to 92%.

The present invention enables one to solve various problems associated with the prior art.

The present invention provides toner for developing an image of electrostatic charge which is superior in various properties such as chargeability, developability, transferability, fixability and cleanability and particularly in chargeability and which is capable of maintaining and exhibiting the above-mentioned properties and particularly the chargeability without being influenced by environmental conditions and has a high reliability. The present invention also provides a developer utilizing such toner for developing an image of electrostatic charge. Further, the present invention provides toner for developing an image of electrostatic charge which has a high transfer efficiency and a low toner consumption rate and which is suitable for a long-life two-component developer for an image of electrostatic charge. The present invention also provides a developer utilizing such toner for developing an image of electrostatic charge. Furthermore, the present invention provides an easy and simple method for producing the above-mentioned superior toner for developing an image of electrostatic charge. In addition, the present invention provides an easy and simple method for forming a full-color image of a high-quality and high reliability. The method for forming an image according to the present invention is highly suitable not only for a system having no cleaning mechanism, namely, a cleaner-less system but also for a toner-recycle system, and a high quality of image can be easily obtained.

What is claimed is:

1. A method for producing toner for developing an image of electrostatic charge, comprising the steps of producing a dispersion liquid of flocculated particles by forming the flocculated particles in a dispersion liquid comprising at least dispersed resin particles, forming combined particles by dispersing a liquid dispersion comprising dispersed fine resin particles into the dispersion liquid of the flocculated particles so that the fine resin particles adhere to the flocculated particles and forming toner particles by fusing the combined particles by heating, wherein the molecular weight distribution curve of the resin in the toner particles as assessed by gel permeation chromatography has at least two peaks or shoulders and wherein the molecular weight of the resin in the fine resin particles is less than the molecular weight of the resin in the flocculated particles.

2. The method for producing toner for developing an image of electrostatic charge according to claim 1, wherein the resin in the toner particles has at least one peak or shoulder in the range of 5,000 to 200,000 and at least one peak or shoulder in the range of 50,000 to 1,000,000.

3. The method for producing toner for developing an image of electrostatic charge according to claim 1, wherein the flocculated particles contain a colorant.

4. The method for producing toner for developing an image of electrostatic charge according to claim 1, wherein the flocculated particles contain a release agent.

5. The method for producing toner for developing an image of electrostatic charge according to claim 1, wherein the molecular weight distribution (weight average molecular weight/number average molecular weight) of the resin in the toner particles is at least 10.

6. The method for producing toner for developing an image of electrostatic charge according to claim 1, wherein the maximum of the average particle size of the resin particles is 1 μm or less.

7. The method for producing toner for developing an image of electrostatic charge according to claim 1, wherein the maximum of the average particle size of the fine resin particles is 1 μm or less.

8. The method for producing toner for developing an image of electrostatic charge according to claim 1, wherein the volume of the fine resin particles is 50% or less of the volume of the toner particles.

9. The method for producing toner for developing an image of electrostatic charge according to claim 1, wherein the glass transition point of the resin corresponding to the lower molecular weight side of the two peaks or shoulders is at least 3° C. higher than the glass transition point of the resin corresponding to the higher molecular weight side of the two peaks or shoulders.

10. The method for producing toner for developing an image of electrostatic charge according to claim 1, wherein the step for producing the combined particles is repeated a number of times.

11. The method for producing toner for developing an image of electrostatic charge according to claim 1, wherein the flocculated particles, at a stage after the step for forming the combined particles but before the step for forming toner particles, are heated to a temperature which is lower than the glass transition point of the resin in the resin particles.

12. A toner for developing an image of electrostatic charge, obtained by a procedure comprising the steps of producing a dispersion liquid of flocculated particles by forming the flocculated particles in a dispersion liquid comprising at least dispersed resin particles, forming combined particles by dispersing a liquid dispersion comprising dispersed fine resin particles into the dispersion liquid of the flocculated particles so that the fine resin particles adhere to the flocculated particles and forming toner particles by fusing the combined particles by heating, wherein the molecular weight distribution curve of the resin in the toner particles by gel permeation chromatography has at least two peaks or shoulders and wherein the molecular weight of the resin in the fine resin particles is less than the molecular weight of the resin in the flocculated particles.

13. The toner for developing an image of electrostatic charge according to claim 12, wherein the average shape coefficient of toner (square of the length of the periphery to 140.

14. The toner for developing an image of electrostatic charge according to claim 12, wherein the resin in the toner particles has at least one peak or shoulder in the range of 5,000 to 200,000, and at least one peak or shoulder in the range of 50,000 to 1,000,000.

15. A developer for an image of electrostatic charge comprising a carrier and toner, wherein the toner is the toner for developing an image of electrostatic charge according to claim 12.

16. A method for forming an image which comprises the steps of forming an electrostatic latent image on an electrostatic latent image carrier, developing the electrostatic latent image by means of a developer layer on a developer carrier to form a toner image, and transferring the toner image to an image receiving medium, wherein the developer layer contains the toner for developing an image of electrostatic charge according to claim 12.

17. A method for producing toner for developing an image of electrostatic charge, comprising:

producing a dispersion liquid of flocculated particles by forming the flocculated particles in a dispersion liquid comprising at least dispersed resin particles, forming combined particles by dispersing a liquid dispersion comprising dispersed resin particles into the dispersion liquid of the flocculated particles so that the resin particles adhere to the flocculated particles and forming toner particles by fusing the combined particles by heating, wherein the molecular weight distribution curve of the resin in the toner particles as assessed by gel permeation chromatography has at least two peaks or shoulders, forming flocculated particles by mixing a (i) dispersion liquid of particles having a lower molecular weight and (iii) a dispersion liquid of particles having a high molecular weight.

18. The method according to claim 17, wherein the (i) dispersion liquid and the (iii) dispersion liquid are the same.

* * * * *